US008002272B2

(12) United States Patent
Miyazawa

(10) Patent No.: US 8,002,272 B2
(45) Date of Patent: Aug. 23, 2011

(54) SHEET CONVEYING APPARATUS AND IMAGE FORMING APPARATUS

(75) Inventor: Hideaki Miyazawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

(21) Appl. No.: 12/510,712

(22) Filed: Jul. 28, 2009

(65) Prior Publication Data

US 2010/0025918 A1 Feb. 4, 2010

(30) Foreign Application Priority Data

Jul. 31, 2008 (JP) ..... 2008-198436

(51) Int. Cl.
*B65H 29/32* (2006.01)

(52) U.S. Cl. ..... 271/197; 271/196; 271/94; 271/276

(58) Field of Classification Search ..... 271/197, 271/196, 276, 94, 96
See application file for complete search history.

(56) References Cited

U.S. PATENT DOCUMENTS

| | | | | |
|---|---|---|---|---|
| 3,527,166 | A * | 9/1970 | Jaffa et al. | 101/474 |
| 4,997,178 | A * | 3/1991 | Ogoda | 271/276 |
| 5,037,079 | A * | 8/1991 | Siegel et al. | 271/3.22 |
| 6,270,074 | B1 * | 8/2001 | Rasmussen et al. | 271/276 |
| 6,672,720 | B2 * | 1/2004 | Smith | 347/104 |
| 7,007,940 | B2 * | 3/2006 | Polidoro et al. | 271/3.11 |
| 7,537,208 | B2 * | 5/2009 | Fukusaka et al. | 271/96 |
| 2003/0011126 | A1 | 1/2003 | Miyazawa | 271/264 |

FOREIGN PATENT DOCUMENTS

| | | | |
|---|---|---|---|
| GB | 2111647 | A * | 7/1983 |
| JP | 1-104560 | | 4/1989 |
| JP | 04112146 | A * | 4/1992 |
| JP | 9-43913 | | 2/1997 |

* cited by examiner

*Primary Examiner* — Stefanos Karmis
*Assistant Examiner* — Luis A Gonzalez
(74) *Attorney, Agent, or Firm* — Fitzpatrick, Cella, Harper & Scinto

(57) ABSTRACT

There are provided a sheet conveying apparatus and an image forming apparatus, which enable stable sheet conveyance without depending on sheet size.
An air suction portion having a duct portion for air suction is provided inwardly of an endless belt having a plurality of suction holes. Air is taken in through the suction holes of the endless belt and the duct portion for air suction by the air suction portion to absorb a sheet onto the endless belt. When the sheet having a sheet conveying direction length in which a sheet trailing end reaches the endless belt before a sheet leading end reaches a fixing device is conveyed, at least part of the portion of the duct portion through which the sheet trailing end passes before the sheet leading end reaches the fixing portion is closed by a shutter.

5 Claims, 10 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus. More specifically, the present invention relates to a sheet conveying apparatus and an image forming apparatus, which convey a sheet absorbed onto an endless belt.

2. Description of Related Art

There has been an image forming apparatus, such as a copying machine, a facsimile, and a laser beam printer, which forms an image on a sheet by an electrophotographic system. When forming an image on a sheet, such image forming apparatus exposes a photosensitive drum according to image information to form an electrostatic latent image on the photosensitive drum.

The electrostatic latent image is developed with toner by a development device so as to be visible as a toner image. The toner image is transferred onto the sheet fed from a sheet feeding portion by a transfer portion. The sheet is then conveyed to a fixing nip between a fixing roller and a pressure roller provided in a fixing portion. The toner image is fixed as a permanent image onto the sheet.

The image forming apparatus has a sheet conveying apparatus which conveys a sheet. The sheet conveying apparatus has a first sheet conveying portion, and a second sheet conveying portion which conveys the sheet absorbed by air to the first sheet conveying portion. The second sheet conveying portion has an endless belt, moves the endless belt on which the sheet is placed, and conveys the sheet to the first sheet conveying portion.

The sheet simply placed on the conveying belt is fluttered while being conveyed. Consequently, the conveyance can be unstable to cause conveying failure. In addition, an unfixed toner image formed on the surface of the sheet can be irregular to cause image failure.

To prevent such sheet fluttering to perform stable conveyance, in Japanese Patent Application Laid-Open Nos. H01-104560 and H09-43913, there is provided the second sheet conveying portion which conveys a sheet absorbed onto the conveying belt.

FIG. 10 is a diagram illustrating the configuration of the related art sheet conveying apparatus having such second sheet conveying portion which conveys a sheet absorbed onto the conveying belt. A second sheet conveying portion 204 has an endless belt 200 holding a sheet S, and an air suction member 201 which generates a negative pressure inwardly of the entrained surface of the endless belt 200 as a member which prevents the fluttering of the sheet S. The air suction member 201 has a duct portion 202, and a suction fan 203 coupled to the duct portion 202.

When the sheet S is conveyed, the suction fan 203 is rotated to generate a negative pressure in the duct portion, so that the sheet S is absorbed onto the endless belt 200 and is then conveyed to a fixing portion 300 configuring the first sheet conveying portion by preventing fluttering of the sheet S. According to the type of the sheet S, the suction force of the suction fan 203 is changed to secure the stable absorption force without depending on the size of the sheet S. Stable sheet conveyance can be performed by preventing fluttering without making a toner image irregular.

In such sheet conveying apparatus and the image forming apparatus having the same, in the case of a sheet larger than A4-size, a sheet trailing end is placed on the endless belt 200 until the sheet reaches the fixing portion 300. As a result, the sheet S can be conveyed to a fixing nip N between a fixing roller 302 and a pressure roller 303 of the fixing portion 300 without decreasing the absorption force.

On the other hand, in the case of a small-size sheet, such as a B5-size sheet and a postcard, a sheet trailing end can reach the endless belt 200 before a sheet leading end reaches the fixing portion 300. Thereafter, a sheet S' is conveyed. As illustrated in FIG. 10, the sheet trailing end passes on the endless belt, and the sheet S' is placed on part of the endless belt 200, not on the whole endless belt.

Air indicated by arrows taken in from a portion L2 of the endless belt 200 on which the sheet S' is not placed becomes significant. Accordingly, the absorption force in a leading end portion L1 of the endless belt 200 on which the trailing end of the sheet S' is placed is decreased to reduce the conveying force. When the conveying force is reduced, the sheet S cannot be pushed into the fixing nip N, and the sheet S' is jammed.

In FIG. 10, a fixing inlet guide 301 is provided between the fixing portion 300 and the second sheet conveying portion 204. The sheet is bent at an angle a just before the fixing nip N by the fixing inlet guide 301 and is then moved toward the fixing nip N. In this state, when the sheet passes through the fixing nip N, the wrinkling and jamming of the sheet can be prevented.

However, the conveying load is increased by providing the fixing inlet guide 301. Consequently, the sheet S is easily separated from the endless belt. The leading end of the sheet S guided by the fixing inlet guide 301 abuts the fixing roller 302. Due to the abutting shock, the sheet S is easily separated from the endless belt 200.

As indicated by a dotted line, if the small-size strong sheet S' is hard to be guided by the fixing inlet guide 301 at the bending angle $\alpha$, the sheet S' is easily separated from the endless belt 200. The abutting shock is easily to be transmitted to the trailing end of the small-size sheet S' to make the sheet conveying force unstable. Further, when the fixing inlet guide 301 becomes dirty by unfixed toner or sheet particles in terms of durability to increase the friction resistance, the conveying force is further insufficient, and the sheet conveying force becomes unstable.

To solve this problem, the suction force of the suction fan 203 as a negative pressure member is increased corresponding to the small-size strong sheet. Then, the operating noise of the suction fan 203 is increased, and the power consumption is wastefully used. When the number of fans is increased along the sheet conveying direction corresponding to the sheet size in the conveying direction, the apparatus becomes larger. Similarly, due to poor suction efficiency, the power consumption is increased.

The present invention has been made in view of such conditions and provides a sheet conveying apparatus and an image forming apparatus, which can stably convey a sheet without depending on sheet size.

SUMMARY OF THE INVENTION

The present invention provides a sheet conveying apparatus which conveys a sheet, including: a rotatable endless belt having a plurality of suction holes; an air suction portion which is provided inwardly of the endless belt, has an opening for air suction, and takes in air through the suction holes of the endless belt and the opening so as to absorb the sheet onto the endless belt; and a changing portion which changes the suction portion from the opening, wherein the changing portion reduces a suction force from the opening corresponding to the portion through which a sheet trailing end passes on the endless belt, while the movement of the sheet of the sheet absorbed onto the endless belt by the air suction portion.

Further features of the present invention will become apparent from the following description of exemplary embodiments (with reference to the attached drawings).

DESCRIPTION OF THE EMBODIMENTS

An exemplary embodiment for carrying out the present invention will be described below in detail with reference to the drawings.

Figure 1:
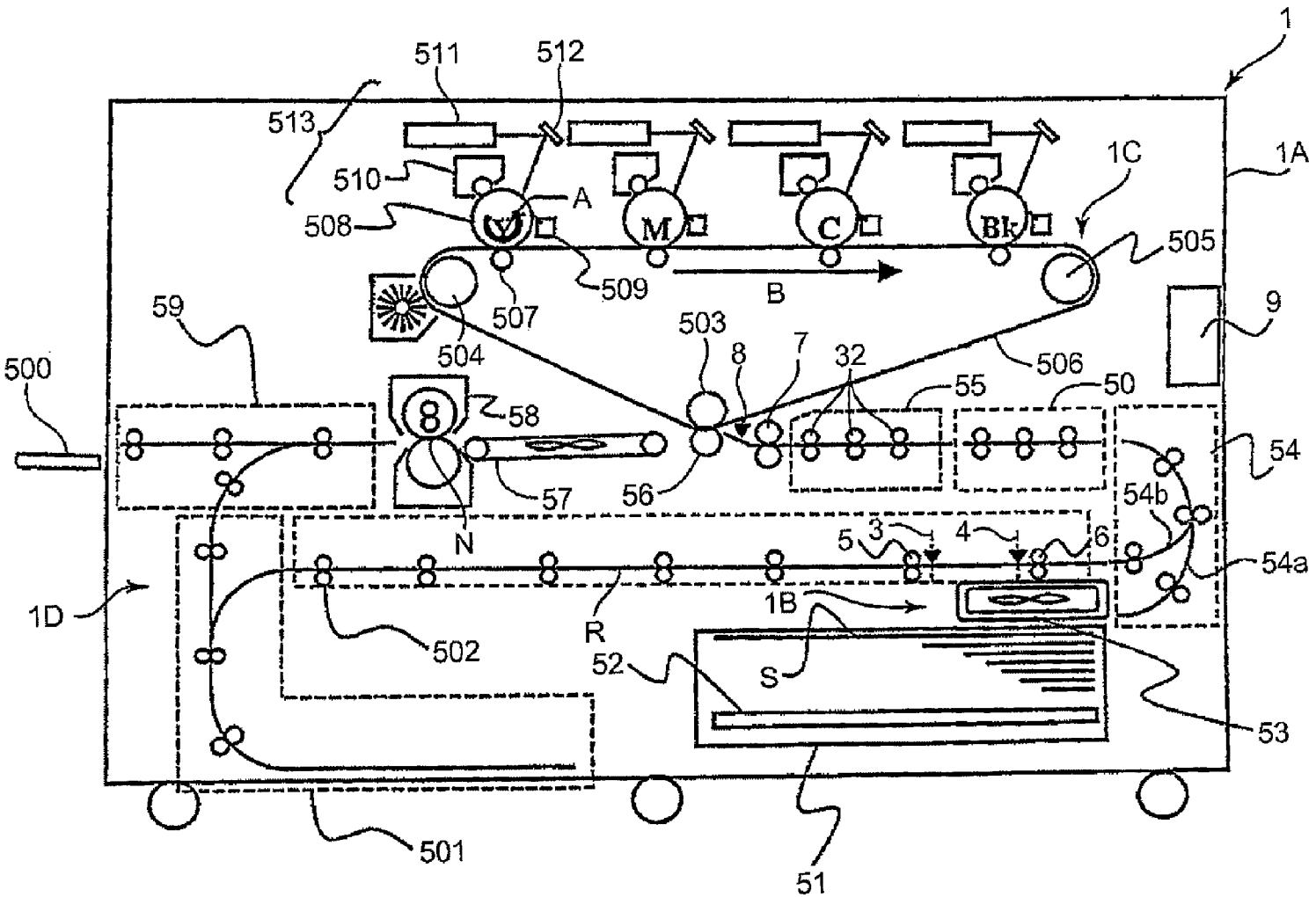
FIG. 1 is a diagram illustrating the schematic configuration of a color image forming apparatus which is an example of an image forming apparatus having a sheet conveying apparatus according to an embodiment of the present invention.

FIG. 1 is a diagram illustrating the schematic configuration of a color image forming apparatus which is an example of an image forming apparatus having a sheet conveying apparatus according to an embodiment of the present invention.

In FIG. 1, there are provided a color image forming apparatus 1 and a color image forming apparatus body 1A (hereinafter referred to as an apparatus body). In terms of configuration, the color image forming apparatuses are classified as either a tandem system in which a plurality of image forming portions are arranged in tandem manner or a rotary system in which a plurality of image forming portions are cylindrically arranged. The color image forming apparatuses are classified as either a direct transfer system which directly transfers a toner image onto a sheet from a photosensitive drum or an intermediate transfer system which transfers a toner image onto an intermediate transfer member, and then, onto a sheet.

Unlike the direct transfer system, the intermediate transfer system need not hold the sheet onto a transfer belt and can correspond to various sheets such as a very thick sheet and a coated sheet. Furthermore, the intermediate transfer system is suitable for realizing high productivity from the features of a parallel process in a plurality of image forming portions and full-color image integrated transfer. The color image forming apparatus 1 according to this embodiment includes an intermediate transfer tandem system in which image forming units for four colors are arranged on an intermediate transfer belt in tandem manner.

The apparatus body 1A has an image forming portion 513, a sheet feeding portion 1B which conveys a sheet S, and a transfer portion 1C which transfers a toner image formed by the image forming portion 513 onto the sheet S fed by the sheet feeding portion 1B. In addition, the apparatus body 1A has a sheet conveying apparatus 1D which conveys the sheet.

Here, the image forming portion 513 has image forming units for yellow (Y), magenta (M), cyan (C), and black (Bk) each having a photosensitive drum 508, an exposure device 511, a development device 510, a primary transfer device 507, and a cleaner 509. The present invention is not limited to four colors formed by the respective image forming units and to the color arranging order.

The sheet feeding portion 1B has a sheet storing portion 51 which stores the sheet S stacked on a lift-up device 52, and a sheet feeding member 53 which feeds the sheet S stored in the sheet storing portion 51. The sheet feeding member 53 includes a system of using frictional separation by a sheet feeding roller or the like or a system of using separation and absorption by air. In this embodiment, a sheet feeding system by air is taken as an example.

The transfer portion 1C has an intermediate transfer belt 506 which is entrained by rollers such as a driving roller 504, a tension roller 505, and a secondary transfer inside roller 503 and is conveyed and driven in the direction of an arrow B in the drawing.

Here, the toner image formed on the photosensitive drum is transferred onto the intermediate transfer belt 506 by a predetermined pressure force and electrostatic load bias provided by the primary transfer device 507. Further, the intermediate transfer belt 506 provides a predetermined pressure force and electrostatic load bias in a secondary transfer portion formed by the secondary transfer inside roller 503 and a secondary transfer outside roller 56, which are substantially opposite, thereby absorbing an unfixed image onto the sheet S.

The sheet conveying apparatus 1D has a conveying unit 54, a conveying roller device 50, a skew feeding correction device 55 configuring a skew feeding correction portion, a registration roller 7, a pre-fixing sheet conveying portion 57, a branch conveying apparatus 59, a reverse conveying apparatus 501, and a duplex conveying apparatus 502. The pre-fixing sheet conveying portion 57 conveys the sheet onto which the toner image is transferred by the secondary transfer portion to a fixing nip N of a fixing device 58.

When an image is formed in the color image forming apparatus 1 with such configuration, the photosensitive drum 508 is rotated in the direction of an arrow A in the drawing and the surface of the photosensitive drum is uniformly charged by a charging member, not illustrated.

Thereafter, the exposure device 511 emits a light to the rotating photosensitive drum 508 according to a signal of transmitted image information. The photosensitive drum 508 is irradiated with the light via a reflection member 512, as needed, so that a latent image is formed on the photosensitive drum 508. The transfer remaining toner which slightly remains on the photosensitive drum 508 is collected by the cleaner 509 for the next image formation.

The electrostatic latent image formed on the photosensitive drum 508 in this manner is subjected to toner development by the development device 510 to form a toner image on the photosensitive drum. Then, the predetermined pressure force and electrostatic load bias are provided by the primary transfer device 507 to transfer the toner image onto the intermediate transfer belt 506.

Image formation of the image forming units for Y, M, C, and Bk of the image forming portion 513 is performed at the timing for the overlap with the upstream toner image primarily transferred onto the intermediate transfer belt. As a result, finally, the full-color toner image is formed on the intermediate transfer belt 506.

The sheet S is fed at the image forming timing of the image forming portion 513 by the sheet feeding member 53. Then, the sheet S passes through a conveying path 54*a* provided in the conveying unit 54 and is then conveyed to the skew feeding correction device 55 which corrects the position shift and skew feeding of the conveyed sheet.

The sheet S whose position shift and skew feeding are corrected by the skew feeding correction device 55 is conveyed to the registration roller 7. After the timing correction is performed by the registration roller 7, the sheet S is conveyed to the secondary transfer portion formed by the secondary transfer inside roller 503 and the secondary transfer outside roller 56.

Thereafter, the full-color toner image is secondarily transferred onto the sheet S in the secondary transfer portion.

Next, the sheet S onto which the toner image is secondarily transferred is conveyed to the fixing device 58 by the pre-fixing conveying portion 57. Then, the toner is melted and fixed onto the sheet S by adding a predetermined pressure force and the heating effect of a heat source, such as, typically, a heater, in the fixing device 58. The sheet S having the obtained fixed image is directly discharged onto a discharge tray 500 by the branch conveying apparatus 59. When the image is formed on both surfaces of the sheet S, the sheet S is then conveyed to the reverse conveying apparatus 501 by the switching of a switching member, not illustrated.

Here, when the sheet S is conveyed to the reverse conveying apparatus 501 as described above, the leading and trailing ends of the sheet S are switched by performing the switchback operation, and the sheet S is conveyed to a re-conveying passage R provided in the duplex conveying apparatus 502. The sheet S is then joined at a sheet re-feeding path 54*b* of the sheet conveying apparatus 54 in timing for the subsequent job sheet conveyed from the sheet feeding portion 1B and is then conveyed to the secondary transfer portion. The image forming process of the second face is the same as that of the first face and is omitted.

A large number of conveying rollers are arranged in the conveying unit 54, the branch conveying apparatus 59, the reverse conveying apparatus 501, and the duplex conveying apparatus 502. As the conveying rollers, the driving roller and the driven roller nipping the sheet therebetween are rotated to convey the sheet. In addition, as the conveying rollers, the driven roller is biased to the driving roller by a biasing member such as a spring, not illustrated, to set a pressure nipping the sheet between both the rollers.

Figure 2:
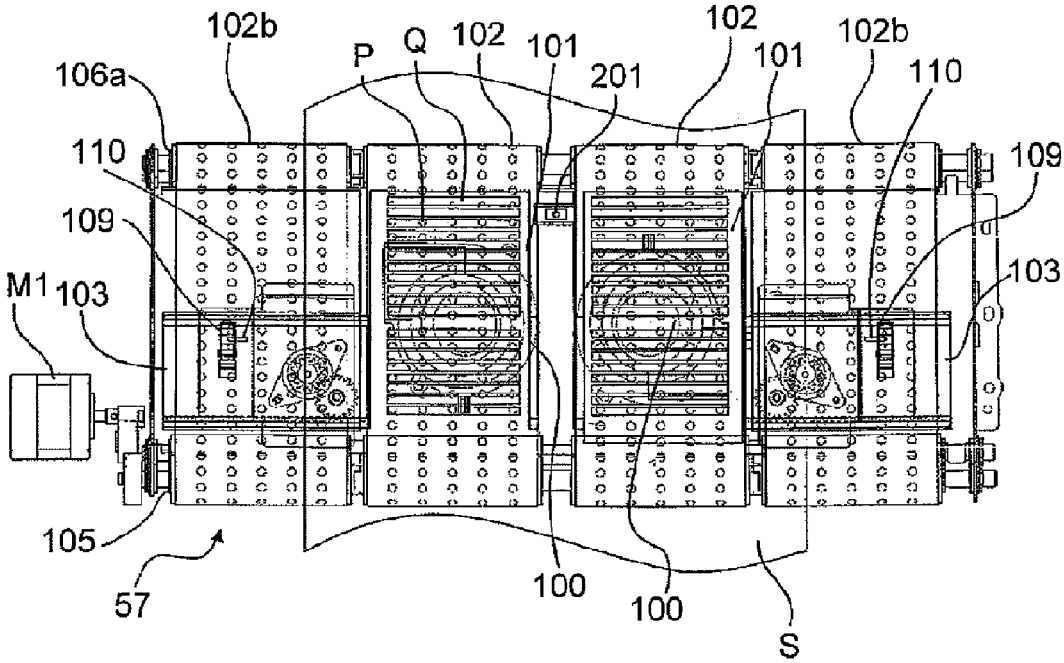
FIG. 2 is a diagram describing the configuration of a pre-fixing sheet conveying portion provided in the color image forming apparatus.
Figure 3A:
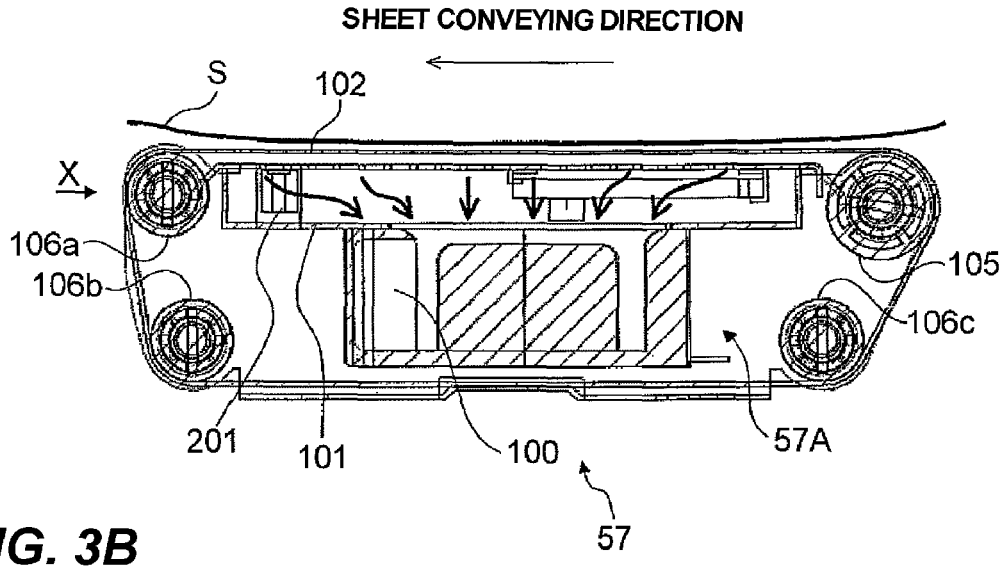
FIGS. 3A and 3B are diagrams illustrating the state that a suction fan of the pre-fixing sheet conveying portion starts to be rotated.
Figure 3B:
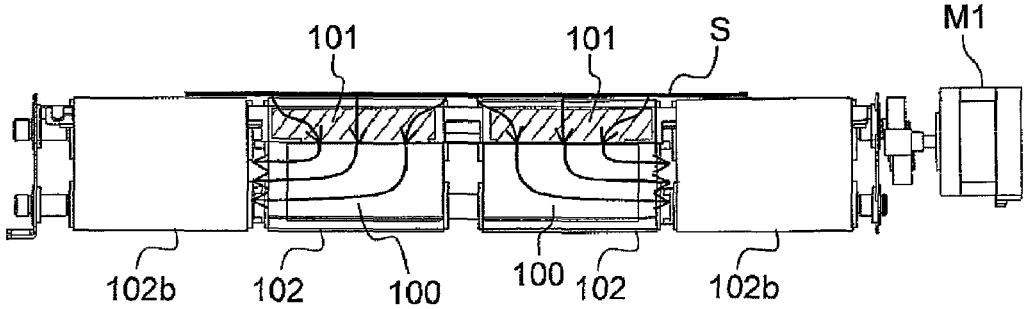

As illustrated in FIGS. 2, 3A, and 3B, the pre-fixing sheet conveying portion 57 configuring the second sheet conveying portion which conveys the sheet to the fixing device 58 configuring the first sheet conveying portion has an endless belt 102 holding the sheet S. Further, the pre-fixing sheet conveying portion 57 has an air suction portion 57A which is arranged inwardly of the endless belt 102 and generates a negative pressure inwardly of the entrained surface of the endless belt 102.

The endless belt 102 is entrained by a driving roller 105 driven by a motor Ml and driven rollers 106*a* to 106*c* and has a plurality of circular suction holes P. Auxiliary endless belts 102*b* which assist the conveyance of the sheet by the endless belt 102 are provided on both sides of the two endless belts 102. The auxiliary endless belts 102*b* do not absorb and convey the sheet and are not formed with the suction holes P.

The air suction portion 57A has a duct portion 101 having an opening configured by a suction hole Q for air suction, and a suction fan 100 coupled to the duct portion 101. The duct portion 101 is provided inwardly of the two endless belts 102 located in the center part in the width direction. The duct portion 101 has a plurality of slit-like suction holes Q which communicate with the suction holes P formed in the two endless belts 102 located in the center part. When the suction fan 100 is rotated, air is taken into the duct portion through the suction holes Q as an opening formed in the duct portion 101 and the suction holes P formed in the endless belt 102. Accordingly, the sheet S is absorbed onto the surface of the endless belt.

FIG. 3A illustrates the state that the suction fan 100 starts to be rotated. When the suction fan 100 is rotated, air is taken into the duct portion through the suction holes P and the suction holes Q, as indicated by arrows. The air taken in through the duct portion 101 is exhausted by the suction fan 100, as indicated by arrows of FIG. 3B.

The inside of the duct portion is always in a negative pressure state by the suction and exhaust operations of the suction fan 100. The sheet S is then absorbed onto the endless belt 102. When the driving roller 105 in the state that the sheet S is absorbed is rotated, the endless belt 102 is rotated. Consequently, the sheet S absorbed onto the endless belt 102 is conveyed to the fixing device 58. The sheet S is absorbed onto the endless belt 102 to prevent the fluttering of the conveyed sheet S, so that stable sheet conveyance is enabled without making the toner image irregular.

Figure 10:
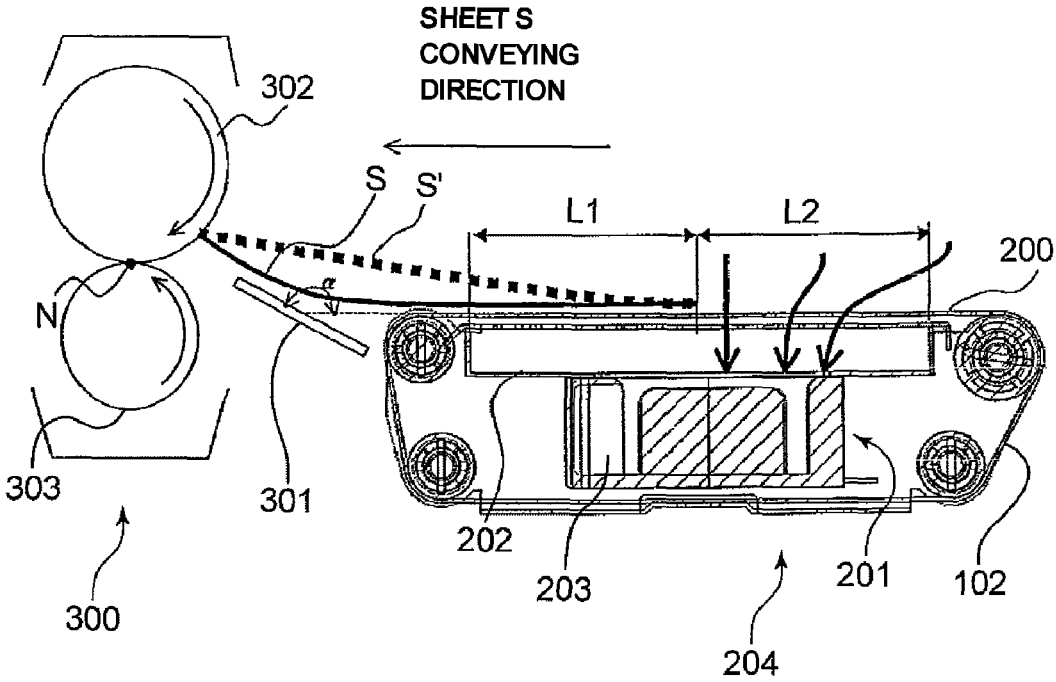
FIG. 10 PRIOR ART
FIG. 10 is a diagram illustrating the configuration of a related art sheet conveying apparatus.

As illustrated in FIG. 10, when the sheet S is a small-size sheet having a short sheet conveying direction length, like a B5-size sheet and a postcard, part of the sheet, not the whole sheet, can be placed on the whole endless belt before the sheet S reaches the fixing device 58.

That is, if the sheet conveying direction length of the sheet is the length in which the sheet trailing end reaches the endless belt before the sheet leading end reaches the fixing device 58, part of the sheet, not the whole sheet, is placed on the whole endless belt before the sheet S reaches the fixing device 58. In this case, the absorption force of the sheet trailing end onto the endless belt 102 is decreased to reduce the conveying force. Therefore, the sheet cannot be stably conveyed to the fixing nip N. As a result, the sheet S cannot be pushed into the fixing nip N and is jammed.

Figure 6:
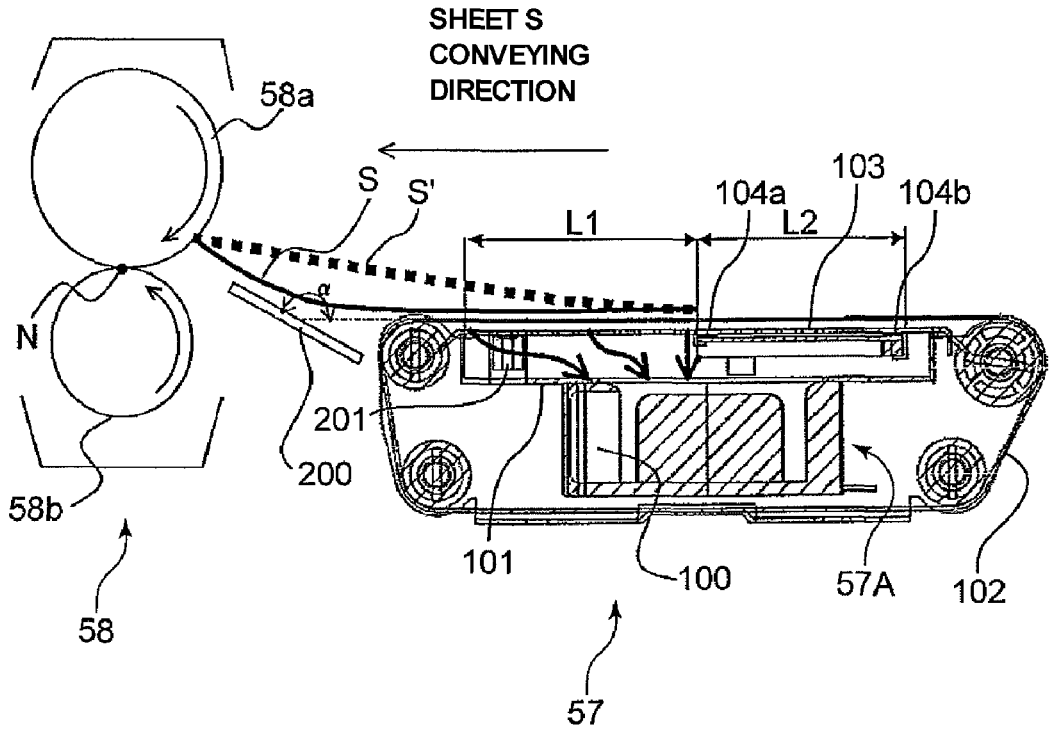
FIG. 6 is a diagram illustrating the state that a small-size sheet in the pre-fixing sheet conveying portion is conveyed.

In this embodiment, at least part of the portion of the duct portion 101 illustrated in FIG. 6, through which the sheet trailing end passes before the sheet leading end reaches the fixing nip N is closed by a shutter. The absorption force can be generated at a sheet trailing end L1 to make the conveyance of the sheet stable, so that the sheet can be reliably pushed into the fixing nip N.

Figure 4:
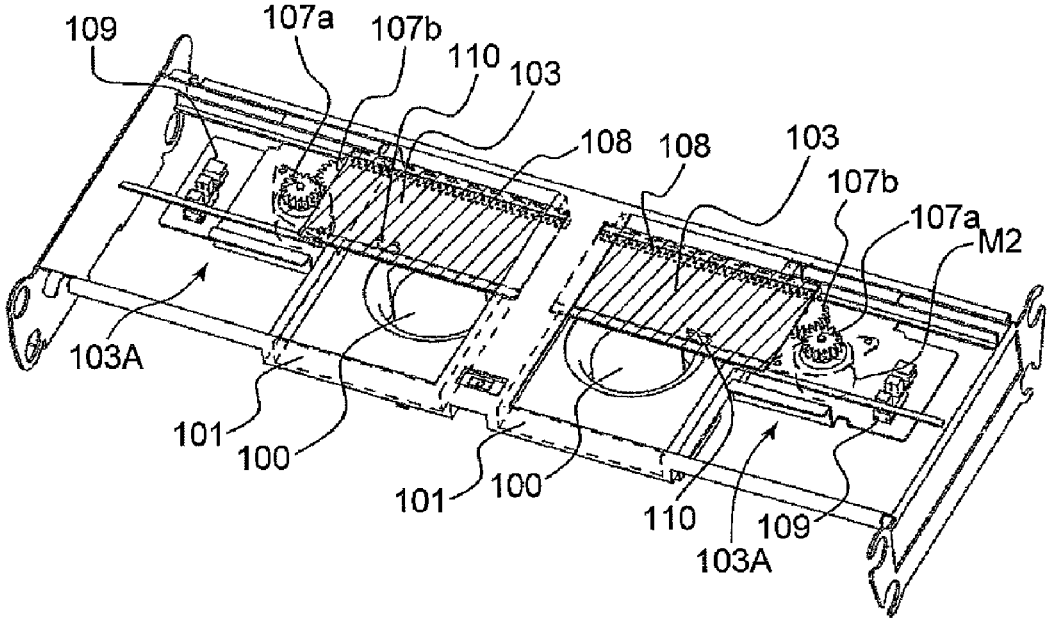
FIG. 4 is a diagram describing the configuration of a shutter and an opening/closing mechanism which opens and closes the shutter, which are provided in the pre-fixing sheet conveying portion.

FIG. 4 is a diagram describing the configuration of a changing portion having such shutter and an opening/closing mechanism which is an opening/closing portion which opens and closes the shutter. In FIG. 4, there are provided a shutter 103 which opens and closes the duct portion 101 and an opening/closing mechanism 103A which opens and closes the shutter 103. In this embodiment, two duct portions 101 are arranged in the width direction. Accordingly, the shutter 103 and the opening/closing mechanism 103A are also provided in the width direction. In this embodiment, the shutter 103 closes part of the duct portion 101, not the whole duct portion 101.

The shutter 103 is formed with a rack gear 108 which is extended in the width direction which is the slide direction of the shutter 103. The rack gear 108 engages a pinion gear 107*b* rotated via a pinion gear 107*a* rotated by a motor M2. The motor M2 is rotated forward to transmit the driving of the motor M2 to the shutter 103 via the rack gear 108 and the pinion gears 107*a* and 107*b* for opening the shutter 103. The motor M2 is reversely rotated so as to close the shutter 103 via the rack gear 108 and the pinion gears 107*a* and 107*b*.

A flag 110 is provided in the shutter 103. The duct portion 101 has a home position detection sensor 109 having a photo interrupter. The shutter 103 is moved in the opening direction. Gradually, the flag 110 interrupts an optical axis of the photo interrupter. When a signal is changed from OFF to ON, the motor M2 is stopped. Consequently, the shutter 103 is moved to the position opening the duct portion 101 illustrated in FIG. 5 and is then stopped. To the contrary, when the shutter 103 is closed, the motor M2 is reversely rotated by a predetermined number of pulses. The shutter 103 is then moved to the position closing the duct portion 101 as illustrated in FIG. 4 and is then stopped.

As already described, in the conveyance of the small-size sheet, part of the sheet, not the whole sheet, can be placed on the whole endless belt when the sheet S reaches the fixing device 58. That is, in the conveyance of the small-size sheet, as illustrated in FIG. 6, the sheet trailing end reaches the endless belt 102 before the sheet leading end reaches the fixing device 58 and thereafter, when a sheet S' is conveyed, a portion L2 on which the sheet trailing end is not placed occurs in the endless belt 102.

The portion L2 of the endless belt 102 on which the sheet trailing end is not placed, that is, the upper portion of the duct portion 101 off the moving sheet trailing end, is closed by the shutter member 103. Consequently, the suction force in the suction hole Q as an opening from the portion corresponding to the portion L2 on which the sheet trailing end is not placed is decreased to reduce the loss of the suction force. Therefore, when the leading end of the sheet S' reaches the fixing device 58, the absorption force can be maintained in the leading end portion L1 of the endless belt 102. The opening amount (opening rate) of the suction hole Q is decreased to prevent the reduction of the absorption force of the sheet onto the endless belt 102. As a result, the sheet S' can be stably conveyed to the fixing nip N between a fixing roller 58*a* and a pressure roller 58*b* provided in the fixing device 58.

Figure 7:
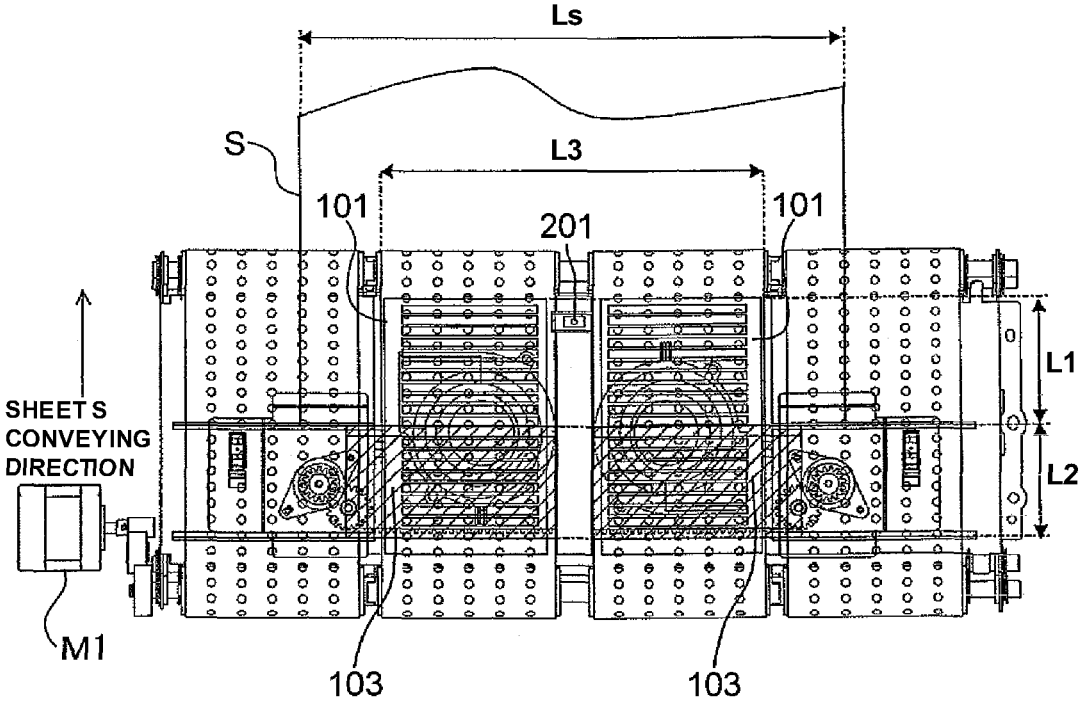
FIG. 7 is a diagram illustrating the position of the shutter when the small-size sheet is conveyed.

Seal members 104*a* and 104*b* are provided between the duct portion 101 and the shutter 103. The portions between the duct portion 101 and the shutter 103 are sealed by the seal members 104*a* and 104*b* to prevent air release when the shutter is operated. In this embodiment, as illustrated in FIG. 7, the duct portion 101 is provided in the portion inwardly of the smallest sheet size L3. This can prevent the suction leakage of the sheet S in the width direction.

As illustrated in FIG. 6, the duct portion 101 has a fixing conveying sensor 201 as a detection portion which detects the sheet conveyed by the endless belt 102. In FIG. 6, a fixing inlet guide 200 bends the sheet at an angle $\alpha$ just before the fixing nip N for preventing wrinkling and then guides the sheet.

Figure 8:
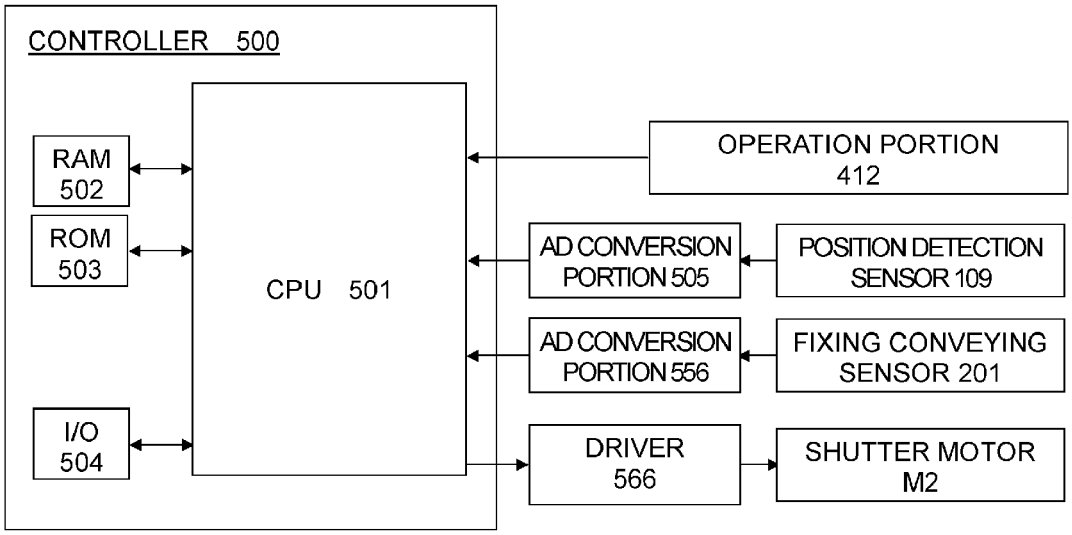
FIG. 8 is a control block diagram of the opening/closing control of the shutter.

FIG. 8 is a control block diagram of the opening/closing control of the shutter 103 of the changing portion according to this embodiment.

In FIG. 8, a controller 500 has a CPU 501, a ROM for storing program 503, a RAM for temporarily storing data 502, an I/O for communication 504.

Information on size which is sheet conveying direction length information on the sheet S to be used and information on the number of sheets are input by a user from an operation portion 412 as an inputting portion to the controller 500.

A sheet detection signal, that is, a leading end detection signal or a trailing end detection signal, is input from the fixing conveying sensor 201 via an AD conversion portion 556 to the controller 500. The controller 500 controls the driving of the shutter motor M2 via a driver 566 according to the sheet detection signal and the opening/closing timing of the shutter 103.

A detection signal is input from the home position detection sensor 109 via an AD conversion portion 505 to the controller 500. The controller 500 controls the opening/closing position of the shutter member 103 according to the detection signal.

Figure 9:
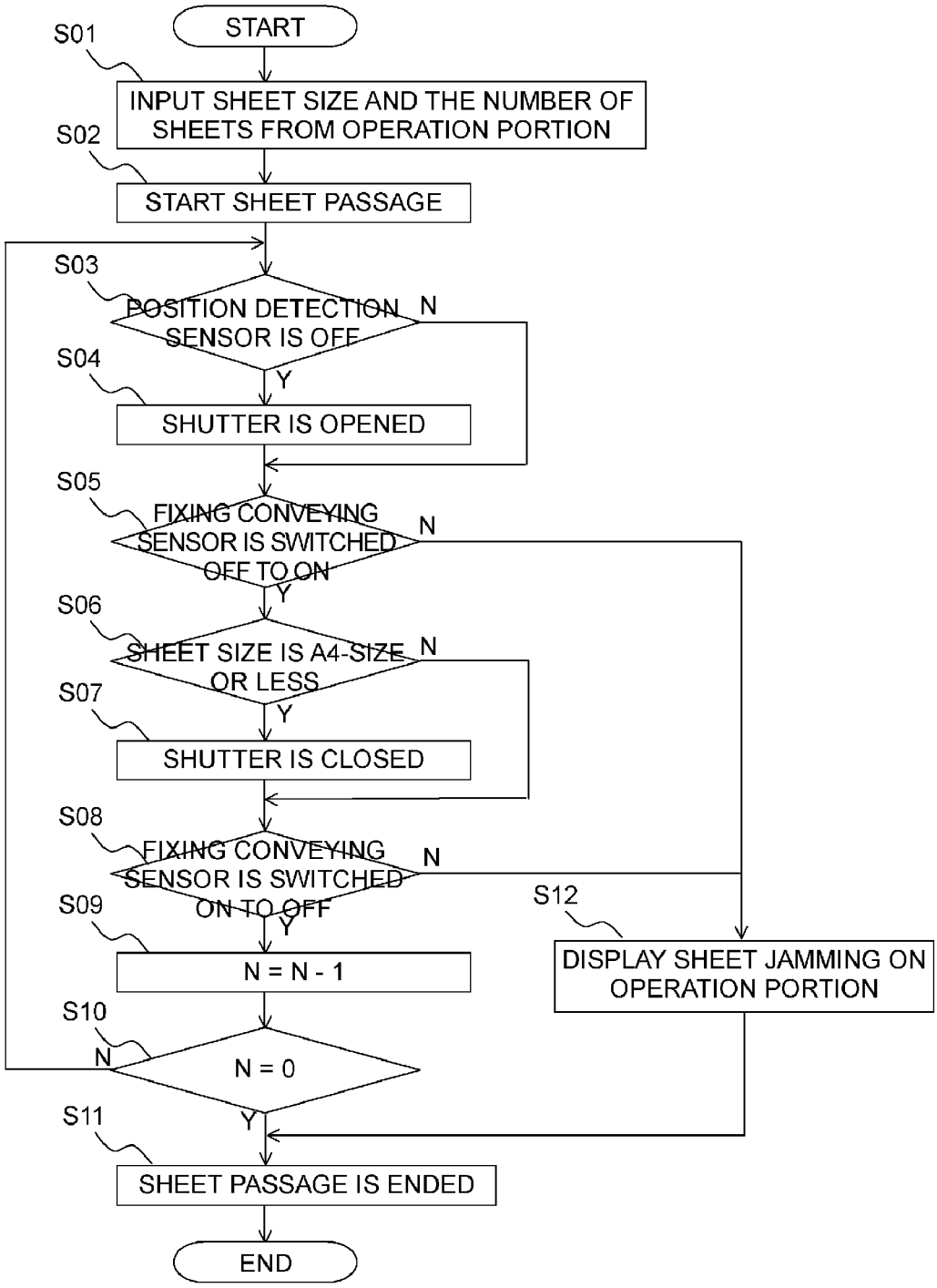
FIG. 9 is a flowchart of the opening/closing control of the shutter at the time of sheet passage.

The opening/closing control of the shutter 103 in sheet passage will be described with reference to a flowchart illustrated in FIG. 9.

Figure 5:
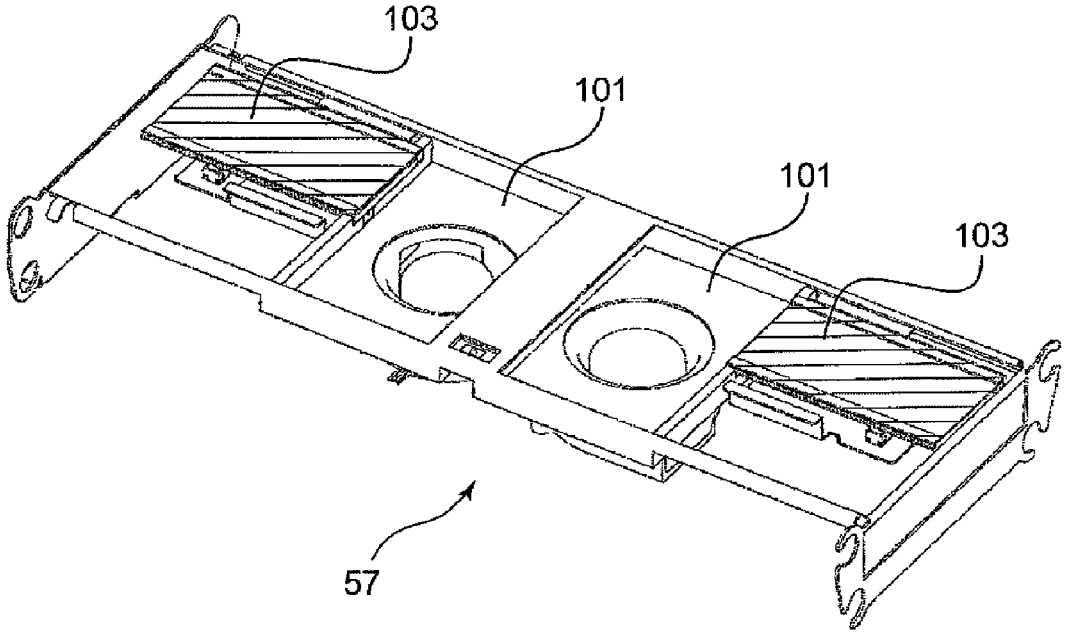
FIG. 5 is a diagram illustrating the state that the shutter is opened.

The power source of the color image forming apparatus 1 is turned on. Before sheet passage (conveyance) is started, the controller 500 stops the shutter 103 in the home position which is the position opening the duct portion 101 as illustrated in FIG. 5 and waits for the instruction of sheet passage start. Then, information on the size of the sheet S passed from the operation portion 412 and information on the number of passed sheets N are input (S01). Thereafter, when a start button, not illustrated, is pressed, sheet passage is started (S02).

Before sheet passage is started, it is determined whether the position detection sensor 109 is OFF (S03). When the position detection sensor 109 is OFF (Y of S03), the shutter 103 is closed. Therefore, the shutter motor M2 is rotated forward to open the shutter 103 (S04) for sheet passage. When the position detection sensor 109 is not OFF, that is, the position detection sensor 109 is ON (N of S03), the shutter 103 is opened. Therefore, sheet passage is directly started.

It is determined whether the fixing conveying sensor 201 detects the sheet leading end so as to be switched from OFF to ON within a predetermined time (S05). When the leading end of the sheet S passes through the fixing conveying sensor 201 and the fixing conveying sensor 201 is switched from OFF to ON within the predetermined time (Y of S05), it is determined according to the input information from the operation portion 412 whether the sheet size is B5-size and postcard size and is A4-size or less (S06). When the fixing conveying sensor 201 is not switched from OFF to ON within the predetermined time (N of S05), sheet delay jam is caused. Consequently, sheet delay jamming is displayed on the operation portion (S12), and sheet passage is then ended (S11).

When it is determined that the sheet size is A4-size or less (Y of S06), the shutter 103 is closed (S07). The upper portion of the duct portion 101 of part or the whole of the portion of the endless belt 102 on which the sheet trailing end is not placed is closed by the shutter 103. For this reason, even before the sheet leading end reaches the fixing nip N of the fixing device 58, the absorption force can be generated in the end portion of the endless belt 102, and the sheet can be stably conveyed to the fixing nip N.

When the sheet size is larger than A4-size (N of S06), the shutter 103 remains opened. The controller 500 selectively opens and closes the shutter 103 according to sheet size.

When the trailing end of the sheet S passes through the fixing conveying sensor 201, the fixing conveying sensor 201 is switched from ON to OFF (Y of S08). Accordingly, a count value N of a soft counter is decreased to N−1 (S09). When the fixing conveying sensor 201 is ON (N of S08), sheet stay jam is caused. Sheet jamming is then displayed on the operation portion (S12). Sheet passage is ended (S11).

It is determined whether the count value N of the soft counter is 0 (S10). When the count value N is not 0 (N of S10), it is determined that sheet passage is successively performed. After the trailing end of the sheet S passes through the fixing conveying sensor 201, it is determined whether the position detection sensor 109 is OFF (S03). When the position detection sensor 109 is OFF (Y of S03), the shutter 103 is closed. The shutter 103 is then opened (S04) for sheet passage of the next sheet S.

When the position detection sensor 109 is ON (N of S03), the shutter 103 is opened. In the state that the shutter 103 is opened, sheet passage of the next sheet S is prepared. After such control is successively performed and the soft counter is 0 (Y of S10), sheet passage is ended (S11).

In this embodiment, in the case where the sheet S A4-size or less, when the sheet leading end reaches the fixing conveying sensor 201 and the signal of the fixing conveying sensor 201 is switched from OFF to ON, as illustrated in FIG. 7, the shutter 103 is closed. Consequently, the upper portion of the duct portion 101 of part or the whole of the portion of the endless belt 102 on which the sheet trailing end is not placed can be closed by the shutter member 103.

Thereafter, the sheet S enters into the fixing nip N and is then started to be conveyed by the fixing device 58. The trailing end of the sheet S passes through the fixing conveying sensor 201. The signal of the fixing conveying sensor 201 is switched from ON to OFF. Then, the shutter 103 is opened for conveyance of the next sheet S.

In this embodiment, part of the duct portion 101 is closed by the shutter member 103 during sheet passage. The absorption force indicated by arrows of FIG. 6 is generated at the sheet trailing end L1 to push the sheet S into the fixing nip N. After the sheet S is pushed into the fixing nip N, the shutter 103 is opened for the next sheet. Such operation is repeated for each sheet, enabling stable sheet absorption and conveyance to the fixing device 58.

In the case of the sheet larger than A4-size, when the sheet leading end reaches the fixing nip N, the sheet trailing end does not reach the endless belt 102 and is not moved off from the duct portion 101. Therefore, the sheet can be pushed into the fixing device 58 without reducing the absorption force.

At least part of the portion of the duct portion 101 through which the sheet trailing end passes before the sheet leading end reaches the fixing nip N is closed. Consequently, the reduction of the absorption force of the sheet can be prevented. Stable sheet conveyance can be performed without depending on sheet size. That is, part of the duct portion 101 is closed by the shutter 103 according to sheet size, thereby preventing the fluttering of the sheet. Stable sheet absorption and conveyance is enabled.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-198436, filed Jul. 31, 2008, which is hereby incorporated by reference herein in its entirety.

What is claimed is:

1. A sheet conveying apparatus having a first sheet conveying portion and a second sheet conveying portion which absorbs a sheet by air and conveys the sheet to the first sheet conveying portion, wherein the second sheet conveying portion includes:

an endless belt having a plurality of suction holes;

an air suction portion which is provided inwardly of the endless belt, has an opening for air suction, and takes in air through the suction holes of the endless belt and the opening so as to absorb the sheet onto the endless belt;

a detection portion which is provided between the first sheet conveying portion and the second sheet conveying portion and detects the sheet conveyed by the second sheet conveying portion;

a shutter which partially opens and closes the opening; and an opening/closing portion which opens and closes the shutter and the opening/closing portion is driven so as to move the shutter to the position closing the opening according to the detection of the sheet leading end by the detection portion and to move the shutter to the position opening the opening according to the detection of the sheet trailing end by the detection portion, wherein when the sheet having a sheet conveying direction length in which a sheet trailing end reaches the endless belt before a sheet leading end reaches the first sheet conveying portion, at least part of the portion of the opening through which the sheet trailing end passes before the sheet leading end reaches the first sheet conveying portion is closed by the shutter.

2. The sheet conveying apparatus according to claim 1, comprising:

an inputting portion which inputs sheet conveying direction length information of the sheet, wherein the shutter is selectively opened and closed according to the sheet conveying direction length information of the sheet from the inputting portion.

3. An image forming apparatus having an image forming portion, a transfer portion which transfers a toner image formed by the image forming portion onto a sheet, and a sheet conveying apparatus which conveys the sheet onto which the toner image is transferred by the transfer portion, comprising:

a first sheet conveying portion and a second sheet conveying portion which absorbs a sheet by air and conveys the sheet to the first sheet conveying portion, wherein the second sheet conveying portion includes:

an endless belt having a plurality of suction holes;

an air suction portion which is provided inwardly of the endless belt, has an opening for air suction, and takes in air through the suction holes of the endless belt and the opening so as to absorb the sheet onto the endless belt;

a detection portion which is provided between the first sheet conveying portion and the second sheet conveying portion and detects the sheet conveyed by the second sheet conveying portion;

a shutter which partially opens and closes part of the opening; and an opening/closing portion which opens and closes the shutter and the opening/closing portion is driven so as to move the shutter to the position closing the opening according to the detection of the sheet leading end by the detection portion and to move the shutter to the position opening the opening according to the detection of the sheet trailing end by the detection portion, wherein when the sheet having a sheet conveying direction length in which a sheet trailing end reaches the endless belt before a sheet leading end reaches the first sheet conveying portion, at least part of the portion of the opening through which the sheet trailing end passes before the sheet leading end reaches the first sheet conveying portion is closed by the shutter.

4. The image forming apparatus according to claim 3, comprising:

an inputting portion which inputs sheet conveying direction length information of the sheet, wherein the shutter is selectively opened and closed according to the sheet conveying direction length information of the sheet from the inputting portion.

5. The image forming apparatus according to claim 3, wherein the first sheet conveying portion is a fixing portion which fixes the sheet onto which the toner image is transferred by the transfer portion.

* * * * *